US011667024B2

(12) United States Patent
Paulsen et al.

(10) Patent No.: US 11,667,024 B2
(45) **Date of Patent: *Jun. 6, 2023**

(54) HAMMER

(71) Applicant: Milwaukee Electric Tool Corporation, Brookfield, WI (US)

(72) Inventors: Alexander J. Paulsen, Milwaukee, WI (US); James A. Cemke, Jr., Richfield, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/745,065

(22) Filed: May 16, 2022

(65) Prior Publication Data

US 2022/0274238 A1 Sep. 1, 2022

Related U.S. Application Data

(63) Continuation of application No. 16/280,487, filed on Feb. 20, 2019, now Pat. No. 11,358,263.

(60) Provisional application No. 62/633,296, filed on Feb. 21, 2018.

(51) Int. Cl.

| | |
|---|---|
| ***B25D 1/02*** | (2006.01) |
| ***B25D 1/06*** | (2006.01) |
| *B26B 23/00* | (2006.01) |
| *B25D 7/00* | (2006.01) |
| *B25D 1/12* | (2006.01) |

(52) U.S. Cl.

CPC ..... *B25D 1/02* (2013.01); *B25D 1/06* (2013.01); *B25D 1/12* (2013.01); *B25D 7/00* (2013.01); *B26B 23/00* (2013.01)

(58) Field of Classification Search

CPC ... B25D 1/02; B25D 1/06; B25D 1/12; B25D 2250/105; B25D 2250/361; B25D 2222/06; B25D 2222/24; B25D 2222/45; B25D 2222/75; B25D 7/00; B25G 1/102; B25G 1/04; B25G 1/01; B25G 3/14

USPC ..... 256/26 r; 81/20, 21, 22, 23, 24, 25, 26, 81/27

See application file for complete search history.

(56) References Cited

U.S. PATENT DOCUMENTS

| | | | | |
|---|---|---|---|---|
| 1,807,347 A * | 5/1931 | Schweigert | ..... | B25D 1/02 D8/78 |
| 3,130,762 A | 4/1964 | Kerr | | |
| 3,148,716 A | 9/1964 | Vaughan, Jr. | | |

(Continued)

FOREIGN PATENT DOCUMENTS

| | | |
|---|---|---|
| TW | D181364 | 2/2017 |

*Primary Examiner* — Monica S Carter
*Assistant Examiner* — Alberto Saenz
(74) *Attorney, Agent, or Firm* — Reinhart Boerner Van Deuren s.c.

(57) ABSTRACT

A hammer is provided that includes a handle, a head, a striking insert, and a claw. The hammer provides for a head with a keyed hole to couple to a keyed projection on a striking insert. The head also includes a dovetail projection that couples to the dovetail connection of the claw. Each component may comprise a different material. For example, the striking insert and the claw comprise one material, and the handle and the head comprise another material. In some embodiments, a slotted punch with a magnetic retainer creates a bore through the face of the head and the striking insert to support a fastener (e.g., a nail) within the head.

20 Claims, 9 Drawing Sheets

(56) References Cited

U.S. PATENT DOCUMENTS

| | | | | |
|---|---|---|---|---|
| 3,640,324 | A | 2/1972 | Porter | |
| 3,721,282 | A | 3/1973 | Hayes et al. | |
| 5,216,939 | A * | 6/1993 | Swenson | B25D 1/02 81/20 |
| 5,996,442 | A | 12/1999 | Carmien | |
| 6,016,722 | A | 1/2000 | Gierer et al. | |
| 6,128,977 | A | 10/2000 | Gierer et al. | |
| D436,821 | S | 1/2001 | Douglas et al. | |
| 6,227,075 | B1 | 5/2001 | Carmien | |
| 6,234,048 | B1 | 5/2001 | Carmien | |
| D452,126 | S | 12/2001 | Hung | |
| 6,435,059 | B1 | 8/2002 | Martinez | |
| 6,457,384 | B1 | 10/2002 | Cox et al. | |
| 6,463,832 | B1 | 10/2002 | Cox et al. | |
| D470,380 | S | 2/2003 | Huang | |
| 6,536,308 | B1 * | 3/2003 | Thorne | B25D 1/02 81/22 |
| D474,667 | S | 5/2003 | Hung | |
| 6,595,087 | B2 | 7/2003 | Whalen et al. | |
| 6,619,408 | B1 | 9/2003 | Lai | |
| 6,655,236 | B1 | 12/2003 | Slack et al. | |
| 6,763,747 | B1 | 7/2004 | Gierer et al. | |
| 6,928,899 | B1 * | 8/2005 | Lin | B25F 1/02 81/20 |
| D519,348 | S | 4/2006 | Chen | |
| D549,064 | S | 8/2007 | Youngren et al. | |
| D605,922 | S | 12/2009 | Reinius | |
| 7,874,231 | B2 | 1/2011 | Hanlon | |
| 7,950,308 | B2 | 5/2011 | Atsumi et al. | |
| 8,047,099 | B2 | 11/2011 | St. John et al. | |
| 8,056,443 | B2 | 11/2011 | Hanlon | |
| 8,104,379 | B2 | 1/2012 | Hanlon | |
| 8,141,458 | B1 | 3/2012 | Spencer et al. | |
| 8,164,045 | B2 | 4/2012 | Troxell et al. | |
| 8,261,634 | B2 | 9/2012 | St. John et al. | |
| 8,387,486 | B2 | 3/2013 | Hanlon | |
| 8,479,612 | B2 | 7/2013 | Sergyeyenko et al. | |
| 8,499,665 | B2 | 8/2013 | St. John et al. | |
| 8,534,643 | B2 | 9/2013 | Lombardi et al. | |
| 8,770,548 | B2 | 7/2014 | Hanlon | |
| 8,833,207 | B2 | 9/2014 | Hanlon | |
| D716,126 | S | 10/2014 | Dahlberg | |
| 8,893,585 | B2 | 11/2014 | Descombes et al. | |
| 9,168,648 | B2 | 10/2015 | Lombardi | |
| D742,712 | S | 11/2015 | Zhang et al. | |
| 9,193,059 | B2 | 11/2015 | Lombardi et al. | |
| D747,943 | S | 1/2016 | Hung | |
| 9,233,462 | B2 | 1/2016 | LaPorte | |
| D748,447 | S | 2/2016 | Hung | |
| D770,254 | S | 11/2016 | Honadel et al. | |
| D770,255 | S | 11/2016 | Honadel et al. | |
| D770,875 | S | 11/2016 | Honadel et al. | |
| D777,549 | S | 1/2017 | Hung | |
| D781,123 | S | 3/2017 | Chen | |
| D781,124 | S | 3/2017 | Chen | |
| D789,760 | S | 6/2017 | Hung | |
| 9,789,597 | B2 | 10/2017 | West et al. | |
| 9,802,304 | B2 | 10/2017 | West et al. | |
| D826,024 | S | 8/2018 | Yu | |
| 2005/0229322 | A1 | 10/2005 | Chiu et al. | |
| 2005/0252345 | A1 | 11/2005 | Carmien et al. | |
| 2008/0053278 | A1 | 3/2008 | St. John et al. | |
| 2008/0210059 | A1 | 9/2008 | Adams et al. | |
| 2009/0056504 | A1 | 3/2009 | Atsumi et al. | |
| 2010/0116096 | A1 | 5/2010 | Hanlon | |
| 2010/0154598 | A1 | 6/2010 | Sergyeyenko et al. | |
| 2010/0199809 | A1 | 8/2010 | St. John et al. | |
| 2010/0200737 | A1 | 8/2010 | Troxell et al. | |
| 2010/0224031 | A1 | 9/2010 | Hanlon | |
| 2011/0079111 | A1 | 4/2011 | Hanlon | |
| 2011/0120270 | A1 | 5/2011 | Lombardi et al. | |
| 2011/0314970 | A1 * | 12/2011 | Chen | B25D 1/02 254/26 R |
| 2012/0036965 | A1 | 2/2012 | St. John et al. | |
| 2012/0085983 | A1 | 4/2012 | Hanlon | |
| 2012/0091409 | A1 | 4/2012 | Hanlon | |
| 2012/0112144 | A1 | 5/2012 | Hanlon | |
| 2012/0119173 | A1 | 5/2012 | Hanlon | |
| 2012/0152066 | A1 | 6/2012 | Descombes et al. | |
| 2013/0126807 | A1 | 5/2013 | Lombardi et al. | |
| 2013/0126808 | A1 | 5/2013 | Lombardi et al. | |
| 2014/0001426 | A1 | 1/2014 | Lombardi et al. | |
| 2014/0165787 | A1 | 6/2014 | Lombardi | |
| 2014/0259695 | A1 | 9/2014 | Guynn et al. | |
| 2015/0068366 | A1 | 3/2015 | Lombardi et al. | |
| 2015/0107417 | A1 * | 4/2015 | LaPorte | B25D 1/06 81/20 |
| 2015/0143959 | A1 | 5/2015 | Lin | |
| 2015/0251303 | A1 | 9/2015 | Flosi et al. | |
| 2016/0039078 | A1 | 2/2016 | West | |
| 2017/0297189 | A1 | 10/2017 | Lombardi | |
| 2018/0001458 | A1 | 1/2018 | West et al. | |
| 2018/0207780 | A1 | 7/2018 | Hung | |

* cited by examiner

HAMMER

CROSS-REFERENCE TO RELATED PATENT APPLICATIONS

The present application is a continuation of U.S. application Ser. No. 16/280,487, filed Feb. 20, 2019, which claims the benefit of and priority to U.S. Provisional Application 62/633,296, filed on Feb. 21, 2018, each of which is incorporated herein by reference in its entirety.

BACKGROUND OF THE INVENTION

The present invention relates generally to the field of hammers. Hand-held striking tools, such as hammers, typically include a metal head for striking a workpiece and a handle coupled to the head.

SUMMARY OF THE INVENTION

One embodiment of the invention relates to a hammer that includes a handle, a head, and a striking insert. The handle defines a longitudinal axis that extends lengthwise through the handle. The handle includes a mounting portion on a first end of the handle and a grip portion on a side surface of the handle. The head is coupled to the mounting portion of the handle and extends in a direction transverse to the longitudinal axis. The head comprises a first material and includes a keyed hole in a face of the head. The striking insert comprises a second material and includes a striking surface and a keyed projection coupled to the keyed hole in the face of the head. In some embodiments, the first material is different than the second material.

Another embodiment of the invention relates to a hammer that includes a handle, a head, and a claw. The handle defines a longitudinal axis extending lengthwise through the handle. The handle further includes a mounting portion on a first end of the handle and a grip portion on a side surface of the handle. The head comprises a first material and includes a striking portion, and a dovetail projection opposite the striking portion along a transverse axis that extends along the head in a direction parallel to the longitudinal axis of the handle. The head is coupled to the mounting portion of the handle and extends along the transverse axis perpendicular to the longitudinal axis. The claw comprises a second material. The claw is slidably coupled to the head via a dovetail connection. The dovetail connection extends along the head in a direction parallel to the longitudinal axis of the handle. In some embodiments, the first material and the second material are different materials.

Another embodiment of the invention relates to a hammer that includes a handle, a head, a striking insert, a slotted punch, and a claw. The handle comprises a first material. The handle defines a longitudinal axis that extends lengthwise through the handle. The handle includes a mounting portion on a first end of the handle and a grip portion on a side surface of the handle adjacent to a second end opposite the first end. The head is coupled to the mounting portion of the handle and extends along a transverse axis orthogonal to the longitudinal axis. The head comprises a second material and further includes a keyed hole in a face of the head; and a dovetail projection opposite the striking portion along the transverse axis. The dovetail projection extends along the head in a direction parallel to the longitudinal axis of the handle. The striking insert comprises a third material. The striking insert further includes a keyed projection coupled to the keyed hole in the face of the head and a slotted punch extending partially through the head. The slotted punch includes a bore, a punch surface, and a magnetic retainer. The bore extends through the face of the head and through the striking insert. The bore extends partially through the head in the direction transverse to the longitudinal axis. The punch surface is disposed in the head where the bore terminates. The magnetic retainer is disposed within the bore to magnetically retain a fastener in the slotted punch. The claw comprises a fourth material. The claw slidably engages with the head via a dovetail connection. The dovetail connection extends along the head in a direction parallel to the longitudinal axis of the handle. In some embodiments, the first material, the second material, the third material, and the fourth material are each different materials.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a hammer are shown. Striking tools such as hammers generally include a striking body, or head, and a handle coupled to the head to enable swinging the hammer. Hammers are useful for a variety of construction, manufacturing, and household tasks. The present application provides a hammer with a variety features that reduce and redistribute weight.

The head includes a keyed hole that receives a striking insert and/or a dovetail projection to receive a claw. To reduce the weight of the hammer and prolong the hammer's useful lifetime, the striking insert and/or claw is/are made from a tough, hardened material (e.g., steel) and the head and handle are made of a light-weight material (e.g., wood, fiber composites, various metal alloys including aluminum and/or titanium alloys). The hammer designs discussed herein provide, among other things, a lightweight yet durable hammer.

Figure 1:
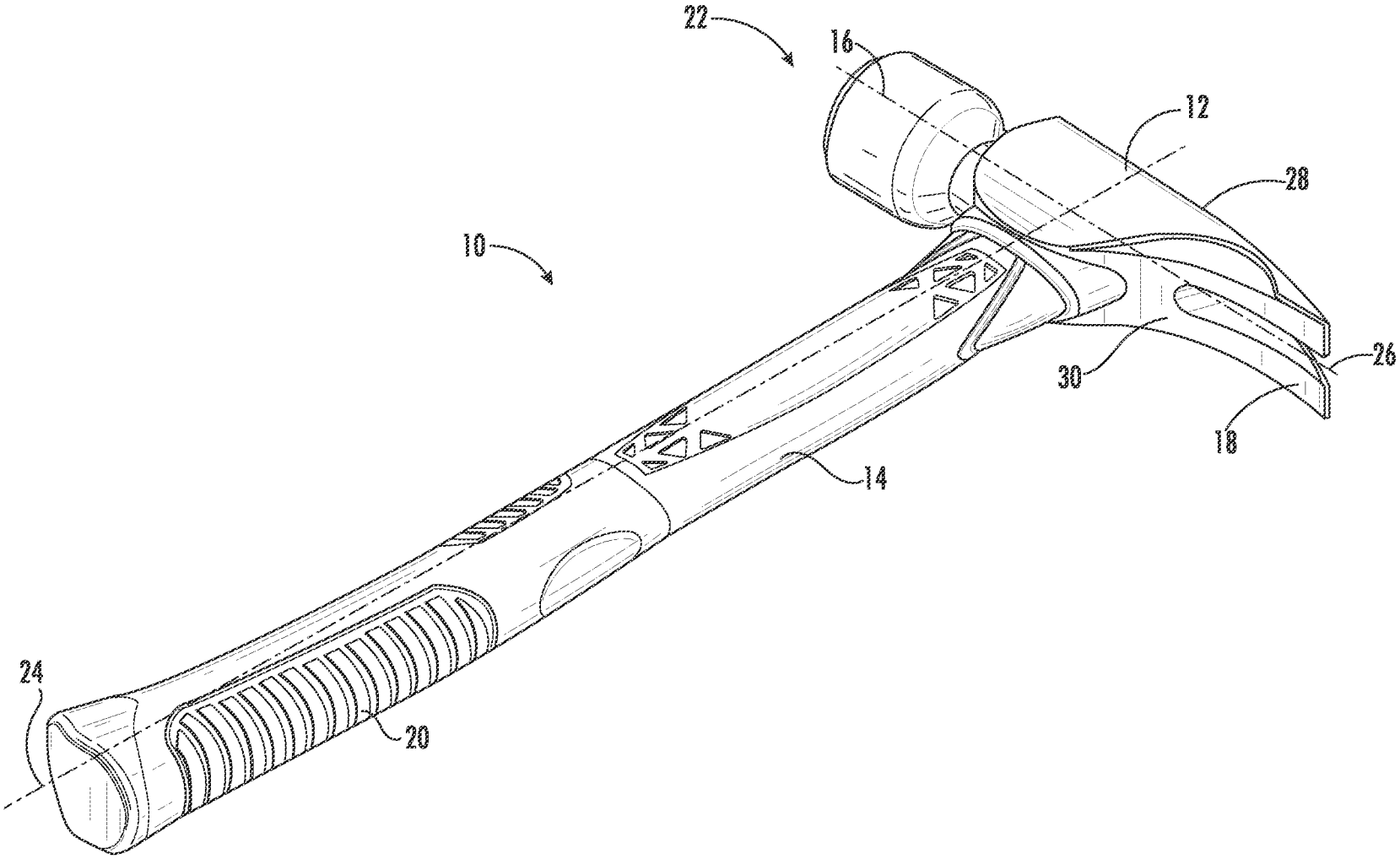
FIG. 1 is a perspective view of a hammer, according to an exemplary embodiment.

FIG. 1 shows a striking tool or hammer 10 with head 12 and handle 14. Head 12 has a first or impact end 16 and a second end or claw 18. A grip 20 is optionally coupled to handle 14 to protect a user's hand from unwanted impact vibrations, improve friction, reduce slippage, etc. A striking insert 22 is coupled to the impact end 16 of the head. A longitudinal axis 24 extends through a length of handle 14. A transverse axis 26 intersects longitudinal axis 24 and extends through a length of head 12. Head 12 has a top side 28 and a bottom side 30 that extend from impact end 16 to claw 18 of head 12.

Head 12 and handle 14 are made from a strong durable impact resistant material, such as a titanium or aluminum alloy. Example alloys include, but are not limited to, 2024 Al, 3003 Al, 6061 Al, 7075 Al, Ti 5Al-2.5Sn, and/or Ti 6Al-4V. Titanium alloys include Grade 5 titanium alloys with approximately 6% aluminum and 4% vanadium. Head 12 and handle 14 can be made from any other impact-resistant material. In addition to the materials already listed, head 12 and/or handle 14 may be made of wood, fiber composite, such as carbon fiber reinforced plastic, fiberglass, or other thermoset composites or plastics.

Figure 2:
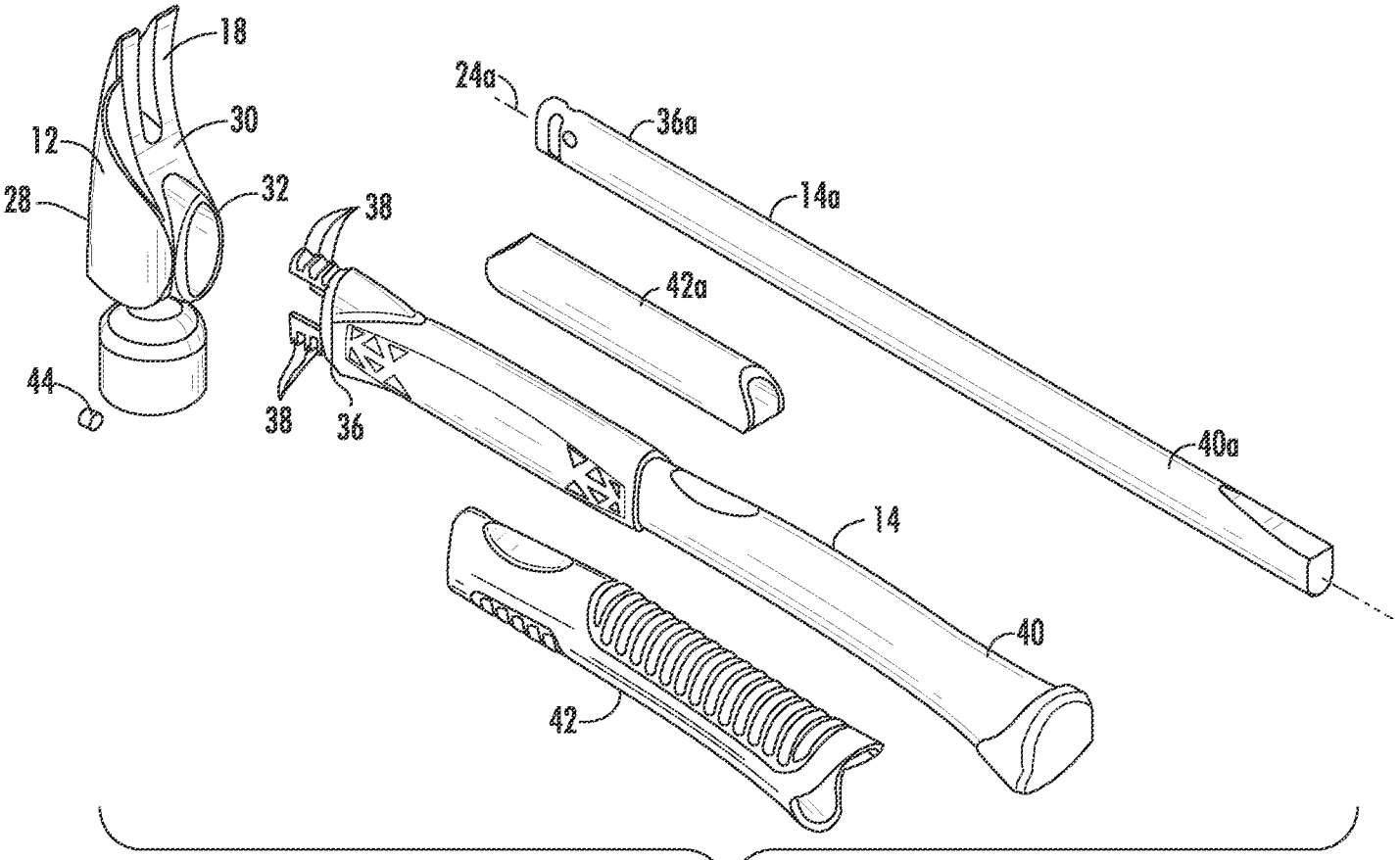
FIG. 2 is an exploded view of the hammer of FIG. 1 showing two different handles, according to an exemplary embodiment.

Handle 14 may include a first material and define longitudinal axis 24 extending lengthwise through handle 14. Handle 14 includes a mounting portion 36 on a first end of handle 14 and a grip portion 40 on a side surface of the handle 14 adjacent to a second end opposite the first end. (FIG. 2). Head 12 couples to the mounting portion 36 of handle 14. In some embodiments, head 12 includes a second material that is different from the first material.

In some embodiments, head 12 weighs between about 5 ounces and about 24 ounces. In various embodiments, head 12 weighs between about 8 ounces and about 17 ounces. Specifically, head 12 weighs between about 10 ounces and about 12 ounces. In some embodiments, handle 14 is 2 feet or more (e.g., a pick or sledgehammer). In various embodiments, handle 14 is between 8 in. and 24 in., specifically handle 14 is between 12 in. and 20 in., or more specifically handle 14 is between 14 in. and 18 in.

FIG. 2 shows an exploded view of hammer 10 with two variations of handle 14. As shown in FIG. 2, a second variation of handle 14 is illustrated as 14*a*, with similar components. For example, handle 14 is made from a fiberglass or fiber composite and handle 14*a* is made from wood or a metal alloy. Handle 14*a* includes a longitudinal axis 24*a*, a mounting portion 36*a*, a grip portion 40*a*, and a grip 42*a*, the same as or similar to the components of handle 14.

For convenience only, reference will be made to the embodiment of handle 14, but the description of handle 14 applies equally to handle 14*a*. Head 12 includes an impact end 16 and a claw 18. Head 12 includes an opening 32 extending from top side 28 to bottom side 30 of head 12. Opening 32 defines a tapered inner wall 34 that receives a mounting portion 36 of handle 14. A circumference of the tapered inner wall 34 at the top side 28 of head 12 is greater than the circumference of the tapered inner wall 34 at the bottom side 30 of head 12. A resin, glue, or other hardening material is used to fill the volume between the mounting portion 36 and the tapered inner wall 34.

In some embodiments, ribbed projections 38 extend from the mounting portion 36 of handle 14. The ribbed projections 38 are configured to be equally spaced from the tapered inner wall 34 along the transverse axis of head 12. In other words, the ribbed projections 38 expand linearly away from the longitudinal axis 24 in a direction approximately equal and opposite to the narrowing formed by the tapered inner wall 34 of opening 32.

Handle 14 includes a grip portion 40 that may optionally be coupled to an outer grip 42. A magnet 44 may couple to head 12 to temporarily connect a fastener (e.g., a nail) to the head 12. For example, a user inserts a nail into a slotted punch 46 (FIG. 3) to temporarily secure and couple a nail to the head 12 of hammer 10. When the hammer 10 impacts a workpiece, the nail is embedded into the workpiece and decouples from the slotted punch 46 of head 12.

With reference to FIGS. 3-6, various perspectives of head 12 are shown to illustrate various components of hammer 10. Striking insert 22 and a claw 18 couple to head 12 to form a clawed embodiment of hammer 10. It should be appreciated, that although the present application describes a conventional clawed hammer 10, other hammers 10 are contemplated. For example, hammer 10 may include a claw hammer 10, a ball peen hammer 10, a club hammer 10, a sledgehammer 10, a carpenter's hammer 10, or another class of hammer 10. Also, hammer 10 may include other hand-held striking tools such as, but not limited to, mallets, axes, hatchets, and picks.

Figure 3:
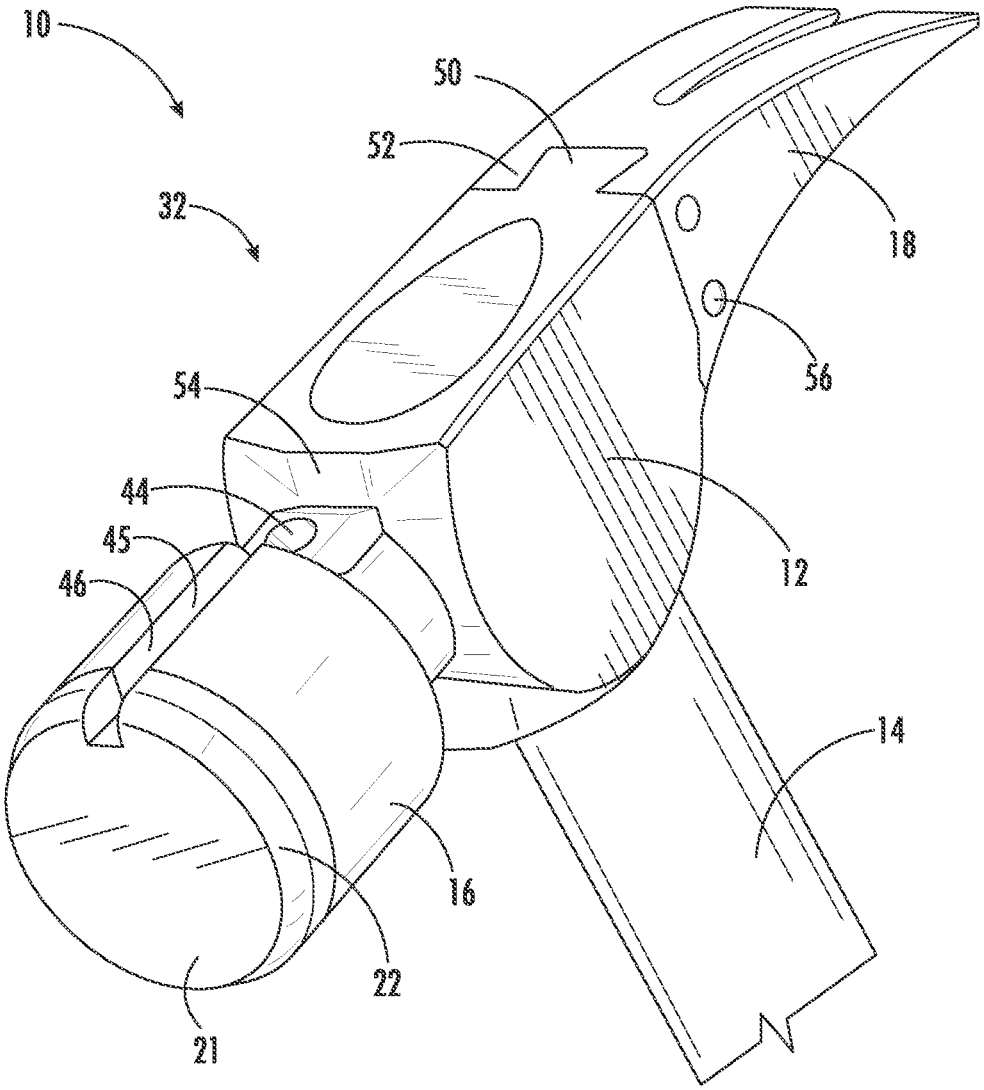
FIG. 3 is a detailed view of a head of the hammer of FIG. 1, according to an exemplary embodiment.
Figure 4:
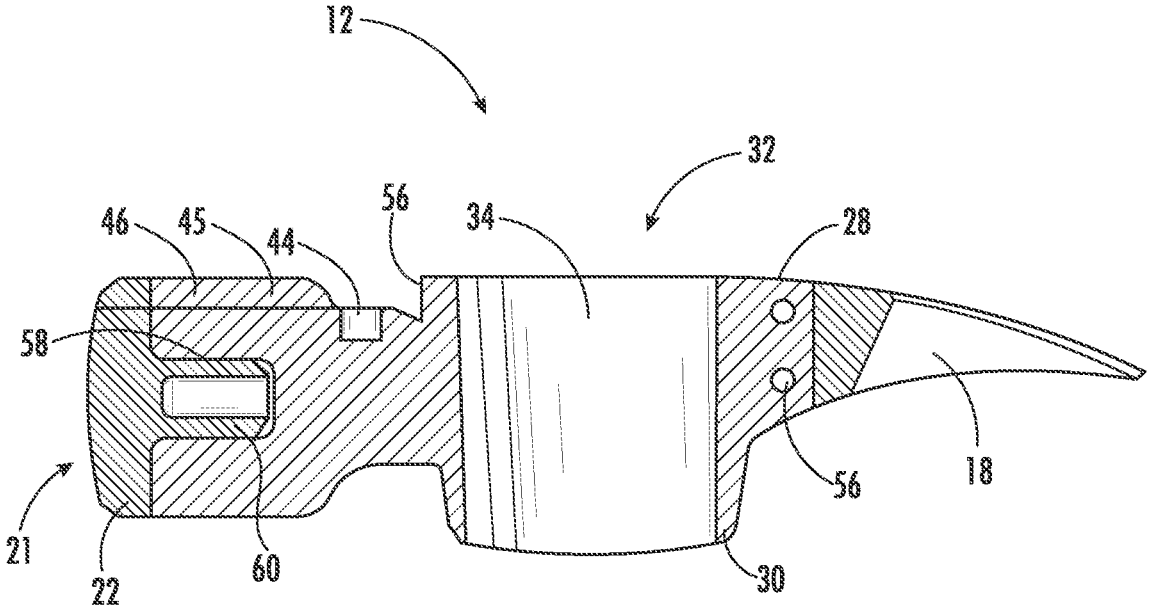
FIG. 4 is a cross-sectional view of the head of the hammer of FIG. 1, according to an exemplary embodiment.

FIG. 3 shows head 12 coupled to striking insert 22 and claw 18. Head 12 includes a keyed hole 58 that extends through a face 48 of head 12 (FIG. 4). On an end of head 12 opposite the keyed hole 58, a dovetail projection 50 is formed along the transverse axis. The dovetail projection 50 extends partially or completely from the top side 28 to the bottom side 30 of head 12 in a direction parallel to the longitudinal axis 24 of the handle 14. Handle 14 extends through opening 32 forming a tapered inner wall 34 within head 12. Striking insert 22 couples to a face 48 (FIG. 5) of head 12 and claw 18 couples to a dovetail projection 50 of head 12. Slotted punch 46 extends through striking insert 22 and part of the impact end 16 of head 12. Slotted punch 46 terminates at a punch surface 54. Magnet 44 is disposed in head 12 along the slotted punch 46 to magnetically couple to a fastener placed within the slotted punch 46. Striking insert 22 is connected to head 12 via a press-fit or other connection. Similarly, claw 18 is coupled to head 12 via a press-fit or other connection. One or more pins or fasteners 56 can additionally secure claw 18 and/or striking insert 22 to head 12.

In the illustrated embodiment, head 12 and handle 14 are made of an aluminum or titanium alloy and the striking insert 22 and the claw 18 are made of steel. In some embodiments, the steel is a forged steel alloy carbide material. In other embodiments, only one of the claw 18 or striking insert 22 is made of steel with the other of the claw 18 and striking insert 22 made of an aluminum or titanium alloy. In yet other embodiments, the striking insert 22 may be made of a first material, and the claw 18 may be made of a second material different than the first material. The head 12 and handle 14 may be made from other lightweight materials (e.g., fiber composite, wood, titanium, aluminum, etc.) and the striking insert 22 and the claw 18 may be made from other durable materials (e.g., titanium alloys, aluminum alloys, various grades of steel, stainless steel, etc.).

In some embodiments, head 12 comprises a first material, handle 14 comprises a second material, striking insert 22 comprises a third material, and claw 18 comprises a fourth material, and the first, second, third, and fourth materials are all different. In other embodiments, any combination of the first, second, third, and fourth materials can be the same or different materials. For example, head 12 comprising the first material is a titanium or aluminum alloy, handle 14 comprising the second material is a composite fiber, striking insert 22 and claw 18 comprising the third and fourth materials, are a forged steel alloy carbide material.

FIG. 4 illustrates a cross-sectional view of head 12 along a plane defined by the longitudinal axis 24 and the transverse axis 26. Claw 18 is coupled to head 12 via a press-fit and/or one or more fasteners 56. Opening 32 extends through head 12 forming a tapered inner wall 34. As illustrated in FIG. 4, tapered inner wall 34 has a circumference at the top side 28 of head 12 that is greater than the circumference of tapered inner wall 34 at bottom side 30 of head 12.

Slotted punch 46 is illustrated as passing through a center of the top side 28 of head 12, but may be disposed at other locations within head 12. Slotted punch 46 terminates at a punch surface 54 and may include a magnet 44 to secure a fastener within a bore 45 of slotted punch 46. Slotted punch 46 extends partially through head 12 and may include bore 45, a punch surface 54, and a magnet 44 or magnetic retainer. Bore 45 extends through face 48 of head 12 and the striking insert 22. In some embodiments, bore 45 also partially extends partially through impact end 16 (FIG. 1) of head 12 along the transverse axis 26. Punch surface 54 forms within head 12 where the bore 45 terminates. Magnet 44 is optionally disposed in the bore 45 of slotted punch 46 to retain a fastener within head 12 magnetically. The slotted punch 46 and/or bore 45 may take on a variety of shapes to support a fastener. For example, slotted punch 46 and/or bore 45 may be square, rectangular, triangular, elliptical, oblong, and/or tear shaped.

Head 12 includes keyed hole 58 that couples to a keyed projection 60 on striking insert 22. FIG. 4 illustrates striking insert 22 coupled to head 12 via keyed projection 60. Striking insert 22 rigidly couples into keyed hole 58 within head 12. In some embodiments, striking insert 22 and head 12 are coupled via a press-fit or interference fit. Press-fit or interference fits may include standard tolerance limits as defined in ANSI B4.1. For example, a "Force or Shrink Fit" [FN] is used to assemble a mating shaft to a mating hole. FN 1 interference fits are suitable for certain metallic assemblies and can produce a semi-permanent joint between the press-fit components. Other press-fits may include an FN 2 interference fit suitable for steel components, or an FN 3 press-fit for heavier steel parts. In one embodiment, the press-fit between keyed projection 60 and keyed hole 58 is an FN 1 press-fit within the tolerances as defined by ANSI B4.1. In alternate embodiments, the striking insert 22 and the head 12 may couple via other fastening mechanisms (e.g., adhesive, spot weld, lateral pin, rivet, fastener, bolt, etc.).

In various embodiments, striking insert 22 includes a lateral pin or fastener 56 that passes through head 12 and striking insert 22. Keyed projection 60 is coupled to keyed hole 58 with a press-fit or interference fit. Striking insert 22 is coupled to the striking portion or face 48 of head 12, a striking surface 21 of the striking insert 22 is a convex radius. In other embodiments, striking surface 21 is a milled repeating pattern of raised pyramidal, circular, square, or triangular projections along the striking surface 21. For example, keyed projection 60 of striking insert 22 is hollow and striking surface 21 of the striking insert 22 is a milled repeating pattern of raised projections separated by depressions formed along the striking surface 21. In this example, striking surface 21 may be convex, flat, or concave.

In some embodiments, claw 18 is coupled to head 12 in the direction of the transverse axis opposite the face 48 of head 12. Claw 18 is slidably engaged with head 12 via a dovetail connection 52 that extends along the head 12. In some embodiments, striking insert 22 and claw 18 both comprise the same material. Claw is joined to head 12 with a lateral pin or fasteners 56 that pass through head 12 and claw 18. The dovetail connection 52 of claw 18 is coupled to the dovetail projection 50 of head 12, for example with an interference fit. In some embodiments, claw 18 and striking insert 22 comprise the same or different materials and handle 14 and head 12 both comprise the same material. For example, head 12 and handle 14 comprise the same material and formed a single, continuous, integral piece or component.

In some embodiments, claw 18 and/or striking insert 22 is/are made from steel, e.g., cold-worked, forged, die-forged, heat treated, and/or quenched steel. In various embodiments, claw 18 and/or striking insert 22 comprise hardened steel with a Rockwell Scale Hardness between 20 HRC to 70 HRC. Specifically, the Rockwell Scale Hardness of the hardened steel is between 30 HRC and 60 HRC, and more specifically, between 40 HRC and 50 HRC.

Figure 5:
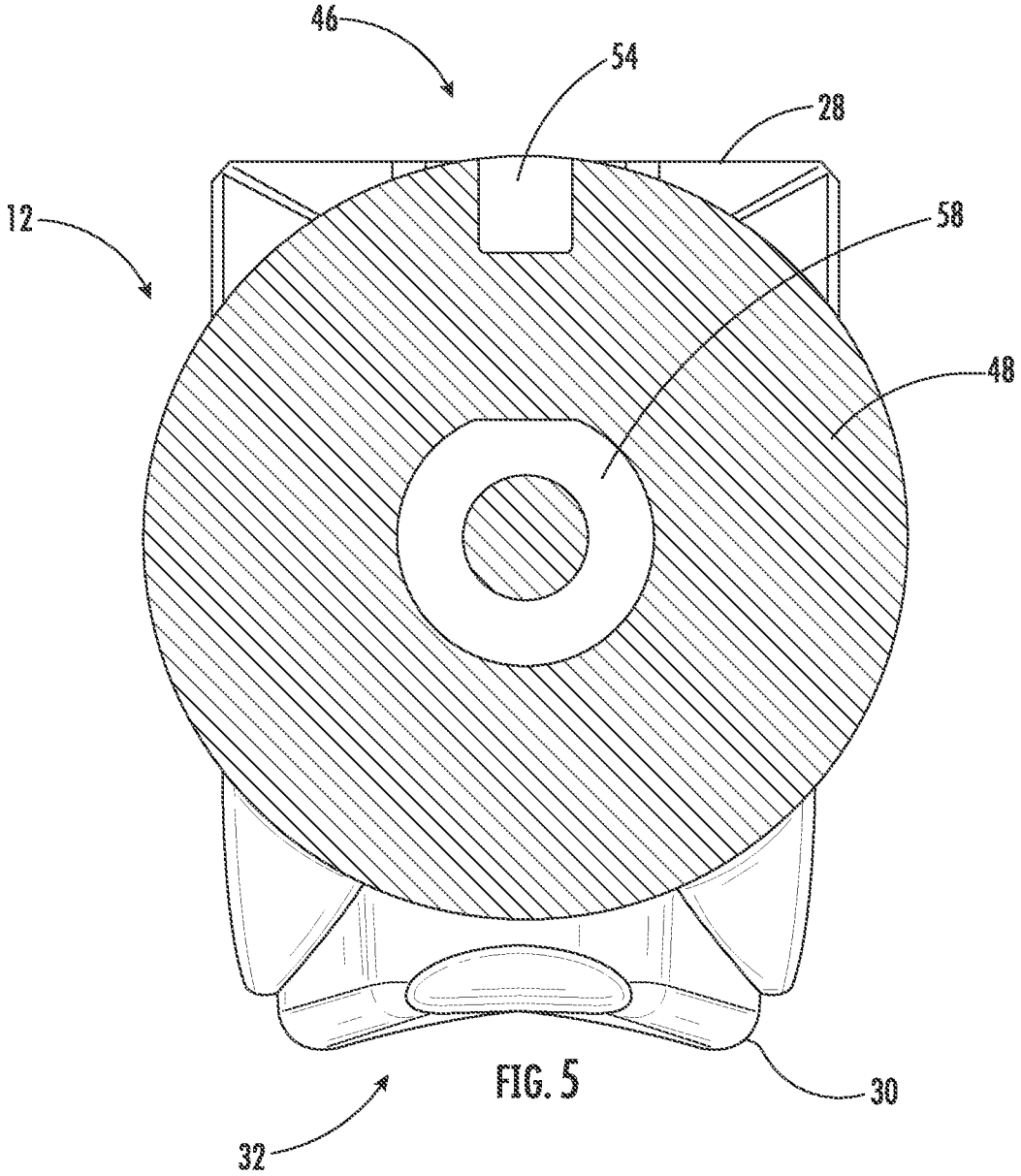
FIG. 5 is an enlarged front view of a face of the head of the hammer of FIG. 1, according to an exemplary embodiment.

FIG. 5 is a front view of head 12 with top side 28 and bottom side 30. Head 12 includes face 48 that forms a keyed hole 58 within head 12 to accept the keyed projection 60 of striking insert 22 (FIG. 4). Head 12 is optionally fitted with a slotted punch 46 and a punch surface 54 within head 12.

Figure 6:
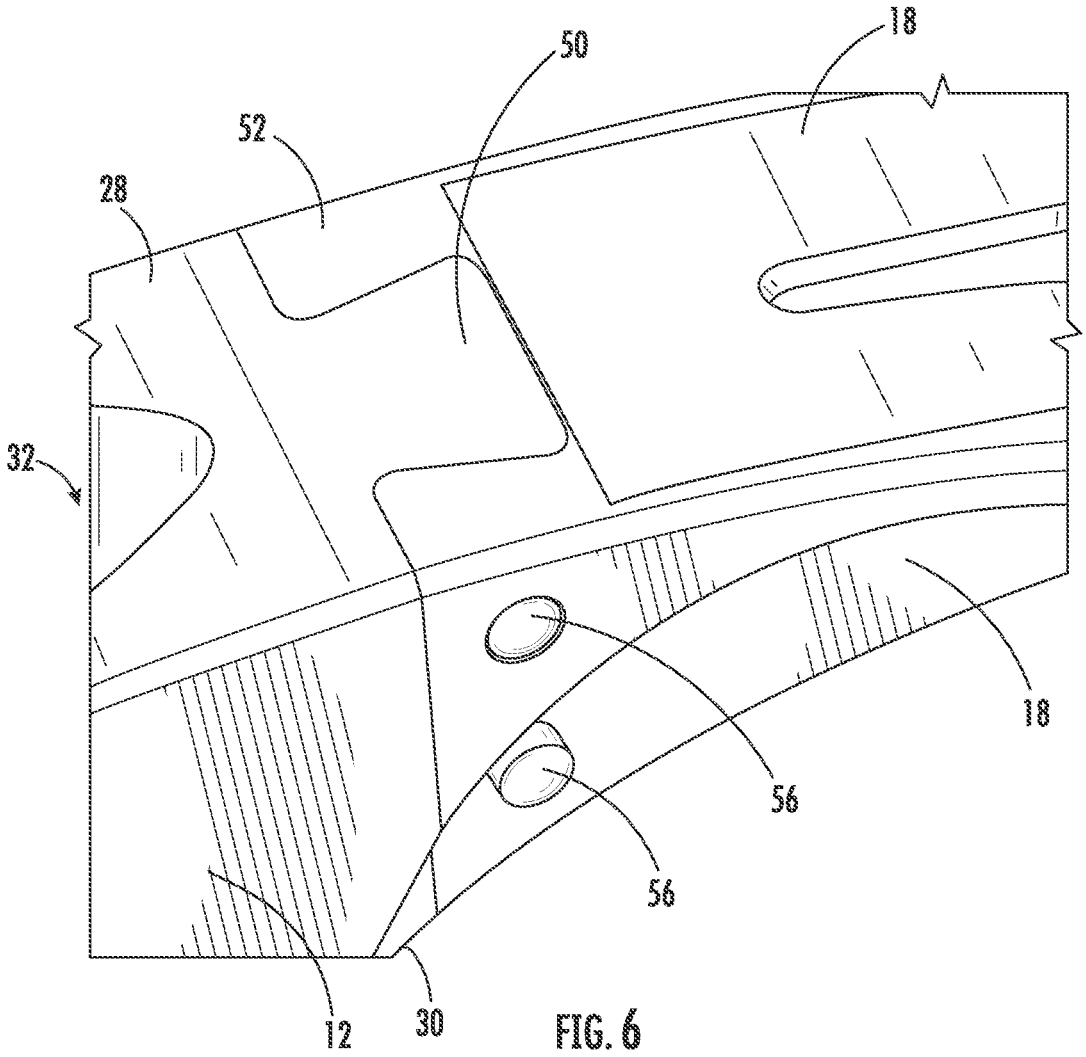
FIG. 6 is an enlarged perspective view of a portion of the head of the hammer of FIG. 1 showing a dovetail projection on the head and a dovetail connection on the claw, according to an exemplary embodiment.

FIG. 6 illustrates the claw 18 engaged with the head 12. In the illustrated embodiment, dovetail connection 52 of the claw 18 is slidably engaged with dovetail projection 50 of the head 12. The dovetail projection 50 and dovetail connection 52 are oriented along the longitudinal axis 24 in a direction parallel to handle 14 (FIG. 3). The orientation of the dovetail projection 50 and dovetail connection 52 joint is suited to withstand the prying force direction when using claw 18 (e.g., to extract a nail, to pry nailed boards apart). As shown in the illustrated embodiment, claw 18 is coupled to head 12 via fasteners 56 (e.g., pins, rivets, screws, etc.) that extend along a direction perpendicular to the handle 14 (FIG. 3).

FIGS. 7-13 illustrate dimensions of striking insert 22 (FIGS. 7-8), head 12 (FIGS. 9-11), and claw 18 (FIGS. 12-13), according to an exemplary embodiment. In other embodiments, different measurements and/or dimensions may accommodate the strength of the different metals or materials in the assembled hammer 10. For example, the head 12 comprises titanium, aluminum, and/or other lightweight materials. The striking insert 22 and the claw may be made of various grades of steel, stainless steel, or other materials robust to striking, prying, or chiseling. Striking insert 22 and claw 18 may be made of the same or different materials.

Figure 7:
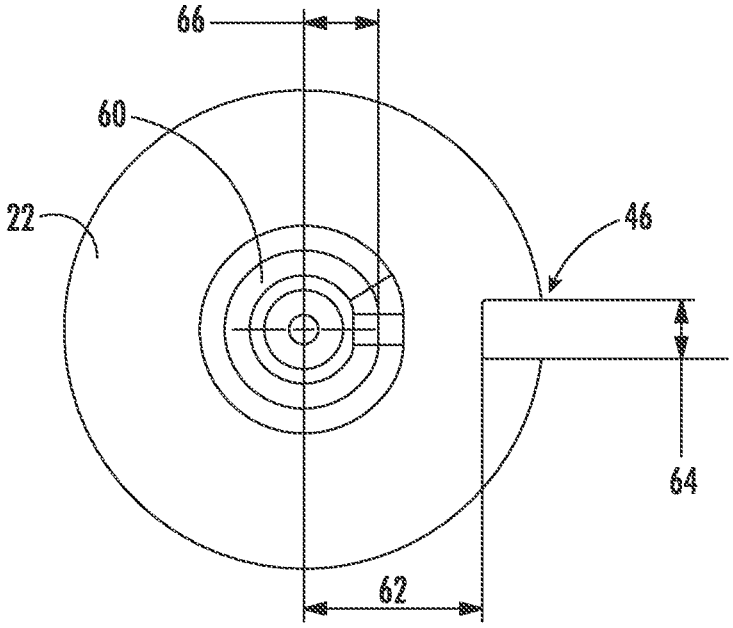
FIG. 7 is a rear view of a striking insert of the hammer head shown in FIG. 1, according to an exemplary embodiment.

FIG. 7 is a front of a striking insert and illustrates relative dimensions of the striking insert of the hammer of FIGS. 3 and 4, according to an exemplary embodiment. For example, FIG. 7 shows a distance 62 between a center of striking insert 22 and slotted punch 46. In some embodiments, distance 62 is between 0.4 in. and 0.7 in., more specifically, between 0.5 in. and 0.6 in. In some embodiments, a width 64 of slotted punch 46 in striking insert 22 is between 0.1 in. and 0.2 in. In some embodiments, a radius 66 of keyed projection 60 is between 0.1 in. and 0.4 in., specifically, radius 66 is between 0.2 in. and 0.3 in.

Figure 8:
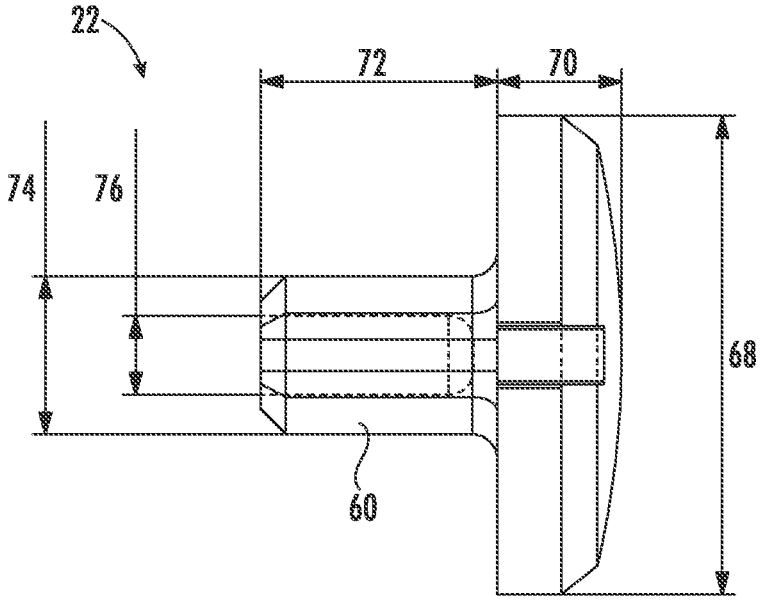
FIG. 8 is a side view of the striking insert of FIG. 7, according to an exemplary embodiment.

FIG. 8 is a side view of the striking insert of FIG. 7 and illustrates relative dimensions of the striking insert 22. In some embodiments, an outer diameter 68 of striking insert 22 is between 1.25 in. and 1.75 in., specifically between 1.4 in. and 1.6 in. In some embodiments, a thickness 70 of striking insert 22 in the transverse direction 26 is between 0.3 in. and 0.5 in., specifically between 0.35 in. and 0.45 in. In some embodiments, a length 72 of the keyed projection 60 is between 0.6 in. and 0.9 in. along transverse axis 26. More specifically, the length 72 of the keyed projection 60 is between 0.7 in. and 0.8 in. In some embodiments, an outer diameter 74 of keyed projection 60 is between 0.4 in. and 0.6 in. and an inner diameter 76 of keyed projection 60 is between 0.2 in. and 0.3 in.

Figure 9:
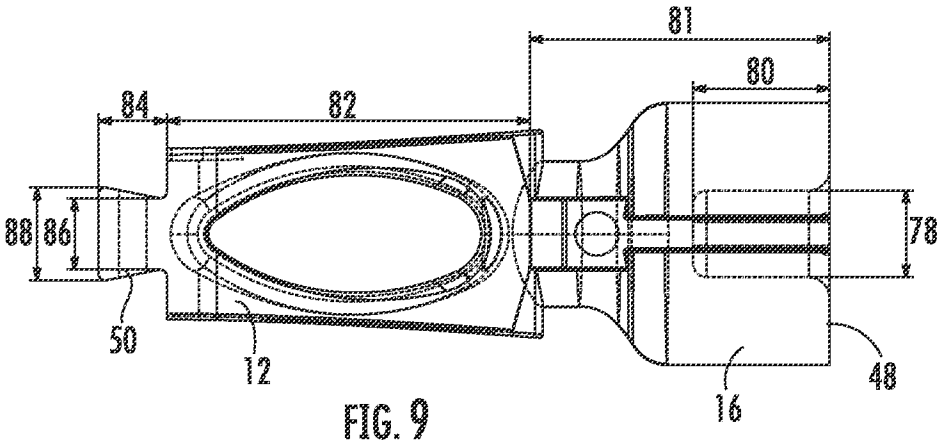
FIG. 9 is a top view of the head of the hammer in FIGS. 3 and 4, according to an exemplary embodiment.

FIG. 9 is a top view of head 12 of the hammer 10 in FIGS. 3 and 4, and illustrates relative dimensions of the head 12, according to an exemplary embodiment. In some embodiments, a diameter 78 of keyed hole 58 is the same as or similar to the outer diameter 74 of keyed projection 60, such that diameter 78 is between 0.4 in. and 0.6 in. A length 80 of keyed hole 58 extending along transverse axis 26 is the same as or similar to a length 72 of keyed projection 60, such that length 80 is between 0.6 in. and 0.9 in., or between 0.7 in. and 0.8 in.

In various embodiments, a length 81 of impact end 16 extending along transverse axis 26 is between 1 in. and 3 in., specifically between 1.5 in. and 2.5 in. In some embodiments, a length 82 of head 12, less dovetail projection 50 and impact end 16, is between 1 in. and 5 in.

In various embodiments, a length 84 of dovetail projection 50 along the transverse axis 26 is between 0.2 in. and 0.4 in. Specifically, length 84 is between 0.25 in. and 0.35 in. In various embodiments, a smaller width 86 of dovetail projection 50 is between 0.3 in. and 0.5 in. and a larger width 88 of dovetail projection 50 is between 0.4 in. and 0.6 in., such that the total width of dovetail projection 50 in a direction perpendicular to transverse axis 26 varies between 0.3 in. and 0.6 in. In some embodiments, dovetail projection 50 tapers from top side 28 to bottom side 30 of head 12.

Figure 10:
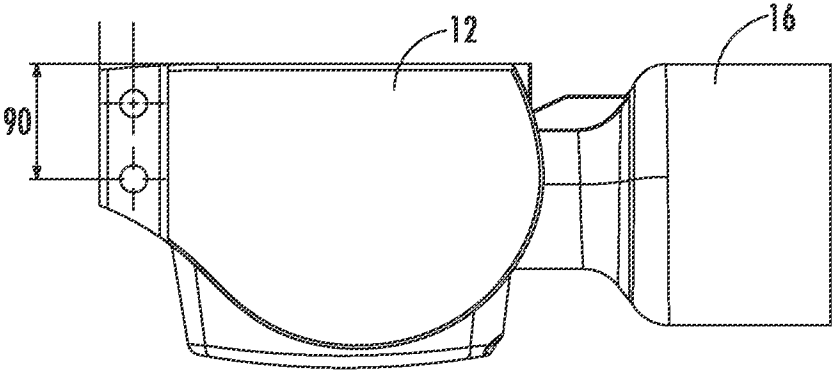
FIG. 10 is a side view of the head of FIG. 9, according to an exemplary embodiment.

FIG. 10 is a side view of the head of FIG. 9 and illustrates a height 90 dimension of dovetail projection 50 that extends in a direction parallel to longitudinal axis 24 of handle 14. In some embodiments, height 90 is between 0.5 in. and 1 in., specifically between 0.6 in. and 0.9 in.

Figure 11:
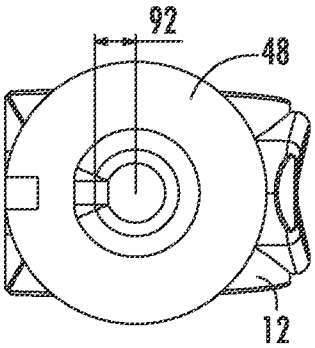
FIG. 11 is a front view of the head of FIG. 9, according to an exemplary embodiment.

FIG. 11 is a front view of the head of FIG. 9, and illustrates relative dimensions of head 12, according to an exemplary embodiment. In some embodiments, face 48 has the same or substantially similar dimensions to striking insert 22, described above concerning FIG. 7. For example, with reference to FIG. 7, a distance 62 between a center of face 48 and slotted punch 46 is between 0.4 in. and 0.7 in., or more specifically, between 0.5 in. and 0.6 in. In some embodiments, a width 64 of slotted punch 46 is between 0.1 in. and 0.2 in. Referring again to FIG. 11, in some embodiments, a radius 92 of keyed hole 58 is the same or substantially the same as radius 66 of keyed projection 60. In some embodiments, radius 92 is between 0.1 in. and 0.4 in., specifically, radius 92 is between 0.2 in. and 0.3 in.

Figure 12:
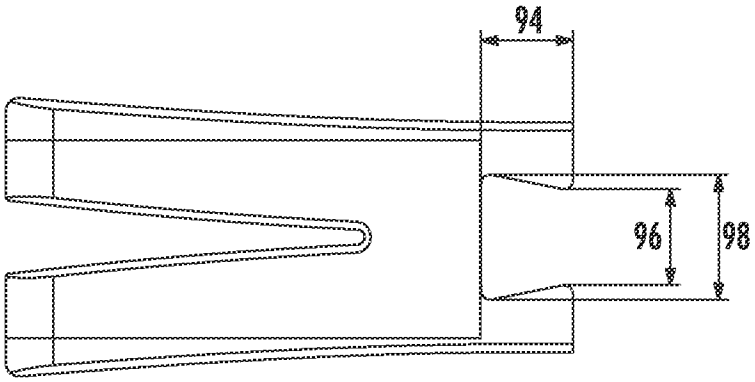
FIG. 12 is a top view of the claw of FIGS. 3 and 4, according to an exemplary embodiment.

FIG. 12 is a top view of the claw 18 of FIGS. 3 and 4, and illustrates relative dimensions of claw 18, according to an exemplary embodiment. In various embodiments, the dimensions of dovetail projection 50 are substantially the same as or similar to the dimensions of dovetail connection 52. For example, a length 94 of dovetail connection 52 along the transverse axis 26 is the same as or similar to length 84 of dovetail projection 50. Specifically, length 94 is between 0.2 in. and 0.4 in., and more specifically length 94 is between 0.25 in. and 0.35 in. In some embodiments, a smaller width 96 of dovetail connection 52 is between 0.3 in. and 0.5 in. and a larger width 98 of dovetail connection 52 is between 0.4 in. and 0.6 in., such that the total width of dovetail connection 52 in a direction perpendicular to transverse axis 26 varies between 0.3 in. and 0.6 in. In some embodiments, dovetail connection 52 tapers from top side 28 to bottom side 30 of head 12.

Figure 13:
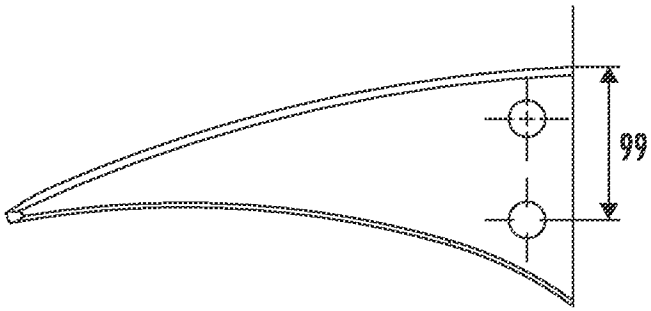
FIG. 13 is a side view of the claw of FIG. 12, according to an exemplary embodiment.

FIG. 13 is a side view of the claw of FIG. 12, and illustrates a height 99 dimension of dovetail connection 52 that extends in a direction parallel to longitudinal axis 24 of handle 14. In various embodiments, height 99 is the same as or similar to height 90 of head 12 and is between 0.5 in. and 1 in., and specifically between 0.6 in. and 0.9 in.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths, and radii, as shown in the Figures are to scale. Actual measurements of the Figures will disclose relative dimensions, angles, and proportions of the various exemplary embodiments. Various exemplary embodiments extend to various ranges around the absolute and relative dimensions, angles, and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A hammer comprising:

a handle defining a longitudinal axis extending lengthwise through the handle, the handle comprising a mounting portion on a first end and a grip portion on a side surface of the handle;

a head coupled to the mounting portion of the handle and extending in a direction transverse to the longitudinal axis, the head comprising a first material, a dovetail projection, and a keyed hole in a face of the head;

a striking insert comprising a second material, a striking surface, an inner surface opposite the striking surface, and a keyed projection extending from the inner surface toward the striking surface, wherein the keyed projection is coupled to the keyed hole in the face of the head via a press-fit connection, wherein the striking insert further comprises a recess formed in the keyed projection and extending from the inner surface towards the striking surface; and a claw comprising a third material and slidably engaged with the head via a dovetail connection extending along the head in a direction parallel to the longitudinal axis of the handle;

wherein the dovetail projection defines a width that varies as the dovetail projection extends from the claw towards the striking surface, and wherein the width of the dovetail projection linearly decreases as the dovetail projection extends towards the striking portion.

2. The hammer of claim 1, wherein the first material is different than the second material.

3. The hammer of claim 1, wherein the striking insert comprises steel with a Rockwell Scale Hardness between 40 HRC and 50 HRC.

4. The hammer of claim 1, wherein the recess is centrally located within the keyed projection.

5. The hammer of claim 1, wherein the keyed projection is centrally located within the striking insert.

6. The hammer of claim 1, wherein the recess defines a cylindrical shape.

7. The hammer of claim 1, wherein the recess in the keyed projection of the striking insert terminates within the striking insert such that the recess consists of only a single opening in the keyed projection.

8. The hammer of claim 1, wherein the keyed hole comprises a lower surface that faces towards the keyed projection.

9. The hammer of claim 1, comprising a slotted punch comprising:

a bore extending through the face and the striking insert and extending partially through the head in the direction transverse to the longitudinal axis;

a punch surface in the head where the bore terminates; and a magnetic retainer.

10. A hammer comprising:

a handle defining a longitudinal axis extending lengthwise through the handle, the handle comprising a mounting portion on a first end and a grip portion on a side surface of the handle;

a head comprising a first material, a striking portion, and a dovetail projection opposite the striking portion along a transverse axis and extending along the head in a direction parallel to the longitudinal axis of the handle, the head coupled to the mounting portion of the handle and extending along the transverse axis perpendicular to the longitudinal axis; and a claw comprising a second material and slidably engaged with the head via a dovetail connection, the dovetail connection extending along the head in a direction parallel to the longitudinal axis of the handle;

wherein the dovetail projection defines a width that varies as the dovetail projection extends from the claw towards the striking portion, and wherein the width of the dovetail projection linearly decreases as the dovetail projection extends towards the striking portion.

11. The hammer of claim 10, comprising a striking insert coupled to the striking portion of the head, the striking insert comprising the second material.

12. The hammer of claim 11, the striking insert comprising a striking surface, an inner surface opposite the striking surface, and a keyed projection extending from the inner surface toward the striking surface, wherein the striking insert further comprises a recess formed in the keyed projection and extending from the inner surface towards the striking surface.

13. The hammer of claim 12, wherein the recess defines a cylindrical shape.

14. The hammer of claim 12, wherein the recess in the keyed projection of the striking insert terminates within the striking insert such that the recess consists of only a single opening in the keyed projection.

15. The hammer of claim 11, wherein the head and the handle comprise the first material and the head and the handle are formed a single, continuous, integral piece.

16. The hammer of claim 11, wherein the claw comprises steel with a Rockwell Scale Hardness between 40 HRC and 50 HRC.

17. A hammer comprising:

a handle comprising a first material and defining a longitudinal axis extending lengthwise through the handle, the handle comprising a mounting portion on a first end and a grip portion on a side surface of the handle adjacent to a second end opposite the first end;

a head coupled to the mounting portion of the handle and extending along a transverse axis orthogonal to the longitudinal axis, the head comprising a second material, the head further comprising a keyed hole in a face of the head and a dovetail projection;

a striking insert comprising a third material, a striking surface, an inner surface opposite the striking surface, and a keyed projection extending from the inner surface toward the striking surface; and a claw comprising a fourth material and detachably engaged with the head via a dovetail connection, the dovetail connection extending along the head in a direction parallel to the longitudinal axis of the handle;

wherein the dovetail projection defines a width that varies as the dovetail projection extends from the claw towards the striking surface, and wherein the width of the dovetail projection linearly decreases as the dovetail projection extends toward the striking surface;

wherein the first material, the second material, the third material, and the fourth material are each different materials.

18. The hammer of claim 17, wherein the keyed projection is coupled to the keyed hole in the face of the head, wherein the striking insert comprises a recess formed in the keyed projection and extending from the inner surface towards the striking surface.

19. The hammer of claim 18, wherein the recess in the keyed projection of the striking insert terminates within the striking insert such that the recess consists of only a single opening in the keyed projection.

20. The hammer of claim 17, comprising a slotted punch comprising:

a bore extending through the face and the striking insert and extending partially through the head in a direction transverse to the longitudinal axis;

a punch surface in the head where the bore terminates; and a magnetic retainer.

* * * * *